US006557632B2

(12) United States Patent
Cernosek

(10) Patent No.: US 6,557,632 B2
(45) Date of Patent: May 6, 2003

(54) METHOD AND APPARATUS TO PROVIDE MINIATURE FORMATION FLUID SAMPLE

(75) Inventor: James T. Cernosek, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 26 days.

(21) Appl. No.: 09/809,153

(22) Filed: Mar. 15, 2001

(65) Prior Publication Data

US 2002/0129936 A1 Sep. 19, 2002

(51) Int. Cl.[7] ..... E21B 43/00; E21B 49/08

(52) U.S. Cl. ..... 166/264; 166/65.1; 166/165; 175/59

(58) Field of Search ..... 166/264, 165, 166/166, 65.1, 373; 175/58, 59

(56) References Cited

U.S. PATENT DOCUMENTS

| | | | | | |
|---|---|---|---|---|---|
| 4,665,983 | A | | 5/1987 | Ringgenberg | 166/250 |
| 4,856,585 | A | | 8/1989 | White et al. | 166/323 |
| 4,903,765 | A | * | 2/1990 | Zunkel | 166/162 |
| 4,915,171 | A | | 4/1990 | McMahan | 166/264 |
| 5,058,674 | A | * | 10/1991 | Schultz et al. | 166/164 |
| 5,303,775 | A | * | 4/1994 | Michaels et al. | 166/264 |
| 5,377,755 | A | | 1/1995 | Michaels et al. | 166/264 |
| 5,549,162 | A | | 8/1996 | Moody et al. | 166/264 |
| 5,662,166 | A | | 9/1997 | Shammai | 166/264 |
| 5,901,788 | A | | 5/1999 | Brown et al. | 166/264 |
| 6,192,984 | B1 | * | 2/2001 | Schultz | 166/264 |
| 6,216,782 | B1 | * | 4/2001 | Skinner | 166/250.01 |
| 2002/0060067 | A1 | * | 5/2002 | Bolze et al. | 166/264 |

* cited by examiner

*Primary Examiner*—David Bagnell
*Assistant Examiner*—Jennifer H Gay
(74) *Attorney, Agent, or Firm*—Madan, Mossman & Sriram, P.C.

(57) ABSTRACT

An apparatus and method is given for evaluating a well fluid sub-sample at the well surface as the sample is transported to the well surface from a downhole wellbore location. The invention collects a formation fluid sample under pressure. The fluid sample is further pressurized with a traveling piston powered by the hydrostatic wellbore pressure. The pressurized formation fluid sample is contained under high pressure within a fixed volume chamber for retrieval to the well surface. Multiple collection tanks can be lowered into the wellbore during the same run to sample different zones with minimal rig time. A pair of valves in series along the supply/discharge conduit respective to each tank accommodates extraction of a field sample to verify the sample integrity while still on location. The tanks can be emptied at the well surface with an evacuation pressure so that the fluid sample pressure is maintained above a selected pressure at all times or transported to an analytical laboratory.

23 Claims, 5 Drawing Sheets

METHOD AND APPARATUS TO PROVIDE MINIATURE FORMATION FLUID SAMPLE

BACKGROUND OF THE INVENTION

1. Field of the Invention

The present invention relates to the art of earth boring and the collection of formation fluid samples from a wellbore. More particularly, the invention relates to methods and apparatus for collecting a deep well formation sample and preserving the in situ constituency of the sample upon surface retrieval. Once the sample is retrieved, this invention describes methods and apparatus for isolating and extracting a sub-sample for a field determination of the quality of the primary sample without altering the primary sample composition.

2. Description of Related Art

Earth formation fluids in a hydrocarbon producing well typically comprise a mixture of oil, gas, and water. The pressure, temperature and volume of formation fluids control the phase relation of these constituents. In a subsurface formation, high well fluid pressures often contain gas within the oil above the bubble point pressure. When the pressure is reduced, as by raising an in situ captured sample of the formation fluid to the surface, the dissolved gaseous compounds separate from the liquid phase sample. The accurate measure of pressure, temperature, and formation fluid composition from a particular well affects the commercial interest in producing fluids available from the well. The data also provides information regarding procedures for maximizing the completion and production of the respective hydrocarbon reservoir.

Certain techniques analyze the well fluids downhole in the wellbore. U.S. Pat. No. 5,361,839 to Griffith et al. (1993) disclosed a transducer for generating an output representative of fluid sample characteristics downhole in a wellbore. U.S. Pat. No. 5,329,811 to Schultz et al. (1994) disclosed an apparatus and method for assessing pressure and volume data for a downhole well fluid sample.

Other techniques capture a well fluid sample for retrieval to the surface. U.S. Pat. No. 4,583,595 to Czenichow et al. (1986) disclosed a piston actuated mechanism for capturing a well fluid sample. U.S. Pat. No. 4,721,157 to Berzin (1988) disclosed a shifting valve sleeve for capturing a well fluid sample in a chamber. U.S. Pat. No. 4,766,955 to Petermann (1988) disclosed a piston engaged with a control valve for capturing a well fluid sample, and U.S. Pat. No. 4,903,765 to Zunkel (1990) disclosed a time delayed well fluid sampler. U.S. Pat. No. 5,009,100 to Gruber et al. (1991) disclosed a wireline sampler for collecting a well fluid sample from a selected wellbore depth, U.S. Pat. No. 5,240,072 to Schultz et al. (1993) disclosed a multiple sample annulus pressure responsive sampler for permitting well fluid sample collection at different time and depth intervals, and U.S. Pat. No. 5,322,120 to Be et al. (1994) disclosed an electrically actuated hydraulic system for collecting well fluid samples deep in a wellbore.

Downhole temperatures in a deep wellbore often exceed 300 degrees F. When a hot formation fluid sample is retrieved to the surface at 70 degrees F., for example, the resulting drop in temperature causes the formation fluid sample to contract. If the volume of the sample is unchanged, such contraction substantially reduces the sample pressure. A pressure drop changes the in situ formation fluid parameters thereby inducing phase separation between liquids and dissolved gases within the formation fluid sample, for example. As another example, dramatic pressure changes in a formation sample may precipitate dissolved solids such as waxes and asphaltines. These types of phase separation represents significant and irreversible changes in the formation fluid characteristics, and reduces the ability to evaluate the actual properties of the formation fluid.

To overcome this limitation, various techniques have been developed to maintain pressure of the formation fluid sample. U.S. Pat. No. 5,337,822 to Massie et al. (1994) teaches the concept of pressurizing a formation fluid sample with a hydraulically driven piston powered by a high pressure gas. Similarly, U.S. Pat. No. 5,662,166 to Shammai (1997) teaches the use of a pressurized gas to charge the formation fluid sample. U.S. Pat. Nos. 5,303,775 (1994) and U.S. Pat. No. 5,377,755 (1995) to Michaels et al. disclose a bi-directional, positive displacement pump for increasing the formation fluid sample pressure above the bubble point so that subsequent cooling does not reduce the fluid pressure below the bubble point.

More recently, U.S. patent application Ser. No. 09/648,410 by Paul A. Reinhardt, filed Aug. 25, 2000, has disclosed a multiple tank sample extraction system in which each sample tank in a magazine carrier has a two stage piston chamber by which the in situ wellbore pressure of a deep well fluid within a sample retrieval chamber is amplified to overcome the contraction consequences of removing a sample of deepwell fluid to the earth surface. At the interface of the apparatus where each of several independently removable tanks is severed from a common charging magazine, a small quantity of high pressure formation fluid is isolated in a sample transfer conduit between a magazine distribution valve and a tank closure valve. Although both valves are closed when an individual tank is removed from its respective magazine alcove, this small quantity of fluid is vented to the atmosphere as a preparatory step to severance of the tank from the magazine for individual transport and sample testing.

Although the quantity of this atmospherically vented fluid is small, it is important to observe the nature and quality of the vented fluid as a qualitative clue to the fluid within the main body of the sample chamber. Notwithstanding extreme care in downhole sampling procedures, it is still possible for the wireline magazine to return with contaminated samples in one or more tanks. Such contamination may take the form, for example, of water seepage from other strata, mud cake deposited against the borehole wall or wellbore drilling fluid. Filtrate from oil based drilling mud is especially a problem.

Samples must be representative of fluid in the formation and consequently must be substantially free of contaminates from drilling operations. In particular, samples need to contain less than a few percent of filtrate from an oil base mud for that sample to be representative of the formation fluid. Usually, 10% contamination in a sample is too much for a reliable pressure/volume/temperature analysis. Acquisition of a formation fluid sample this pure and greater is difficult to obtain. Moreover, it is essential to know the relative contamination in a sample to a reasonable degree of certainty at the time the sample is extracted. The physical and intellectual effort committed to extracting a deepwell sample is of such magnitude that repetition of the effort is to be avoided if possible. Consequently, it is desirable to obtain a small sub-sample of the recovered fluids to determine whether or not the contamination level is sufficiently low to warrant laboratory analysis. It is imperative that this sub-sample be extracted without altering the physical properties of the primary sample reserved for a more expansive laboratory analysis.

It is an object of the present invention, therefore, to controllably secure a portion of the transfer conduit fluid for the purpose of field analysis. Also an object of the present invention is provision of means to evaluate the nature of a fluid sample confined within a high pressure tank chamber without risking the integrity of the sample composition.

SUMMARY OF THE INVENTION

These and other objects of the present invention as will become apparent from the following description of the preferred embodiments are accomplished by a deep well sampling system that is capable of isolating the last portion of sample fluid that is collected into a sample chamber. The sampling system extracts formation fluid directly from the desired formation through a probe that is pressed into the borehole sidewall. This formation fluid is pumped by a downhole equipment pump dedicated to the wellbore equipment along a pump discharge conduit and through a distribution valve or valves. The distribution valve is controlled to direct the flow of pumped fluid drawn from the borehole sidewall into a selected tank or into the wellbore. In a preferred embodiment, each of the tanks may be selectively separated from the magazine for reduced transport weight and handling bulk.

From the distribution valve, the pumped fluid flow is directed along respective supply/discharge conduits having at least two valves between the distribution valve and a respective sample receiving chamber. Significantly, the two valves are positioned along a respective supply/discharge conduit so that the conduit volume between the two valves is greater than the conduit volume between the distribution valve and the outermost of the two valves. Additionally, the conduit volume between the two valves should be about 1% to about 1.5% of the sample chamber volume or more.

A representative embodiment of the invention includes sample tanks having a compound piston within a tank housing interior. The compound piston defines the fluid sample chamber wherein the piston is moveable within the housing interior to selectively change the fluid sample chamber volume. The compound piston comprises an outer sleeve and an inner sleeve. The inner sleeve is moveable relative to the outer sleeve and both are moveable relative to the housing. However, movement of the inner sleeve relative to the outer sleeve is unidirectional. Both sleeves are displaced toward the lower head end by filling the sample collection chamber with formation fluid. A piston face portion of the outer sleeve includes a fluid transfer conduit that is flow controlled by a normally closed valve. The valve is opened by physical engagement with the lower head end of the tank housing. The lower head end of the housing includes a conduit that may be opened directly to the wellbore fluid via a valve in the magazine body that is controlled from the surface. Consequently, when the outer sleeve piston valve is opened by engagement with the lower housing head, wellbore fluid at wellbore pressure is admitted through the outer sleeve piston into an inner chamber. Wellbore pressure in the inner chamber displaces the inner sleeve relative to the outer sleeve whereby the solid structure of the inner sleeve cylinder edge is forced into the high pressure liquid sample chamber. Since the high pressure liquid sample chamber is a completely filled liquid volume, the inner sleeve cylinder edge penetrates the sample chamber only by compression of the liquid.

When the magazine and all tanks are returned to the surface, each tank is separated from the magazine for either shipment to an analysis laboratory or for immediate sample analysis. Because the fluid samples always contain some percentage of filtrate (contamination), it is important to assess the level of contamination without altering the sample volume within the sample chamber and before incurring the expense of laboratory analysis. Often, contamination of less than 10% is acceptable. Under certain conditions, however, a sample may have over 30% contamination and that is usually unacceptable.

For separation of a tank from the magazine, the outer conduit valve is closed. Supply/discharge conduit fluid between the distribution valve in the tank magazine and the outer conduit valve is vented through the wellbore fluid valve in the magazine. Various methods may be employed to investigate or retrieve the sub-sample for sample quality or contamination level. For example, a sight glass or optical port may be employed in the sub-sample conduit to visually or optically determine the sample quality. Other methods may include transfer of the sample into a controlled environment for analysis.

When the tank is free of the magazine, a low pressure receiver tank may be secured to the supply/discharge conduit nipple that serves as the connective interface between the tank and the magazine. With the tank supply/discharge conduit valve most proximate of the high pressure tank chamber closed, the outer valve is opened to release the formation fluid trapped between the two conduit valves into the low pressure receiver where it may be field examined. From such field examination, it may be determined whether the sample is excessively contaminated by wellbore water, oil, mud cake, drilling fluid or oil filtrate from oil based drilling mud.

After the field sample is extracted, the outer conduit valve is again closed and the tank disposed for completion of the laboratory analysis.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which.

DESCRIPTION OF THE PREFERRED EMBODIMENT

Figure 1:
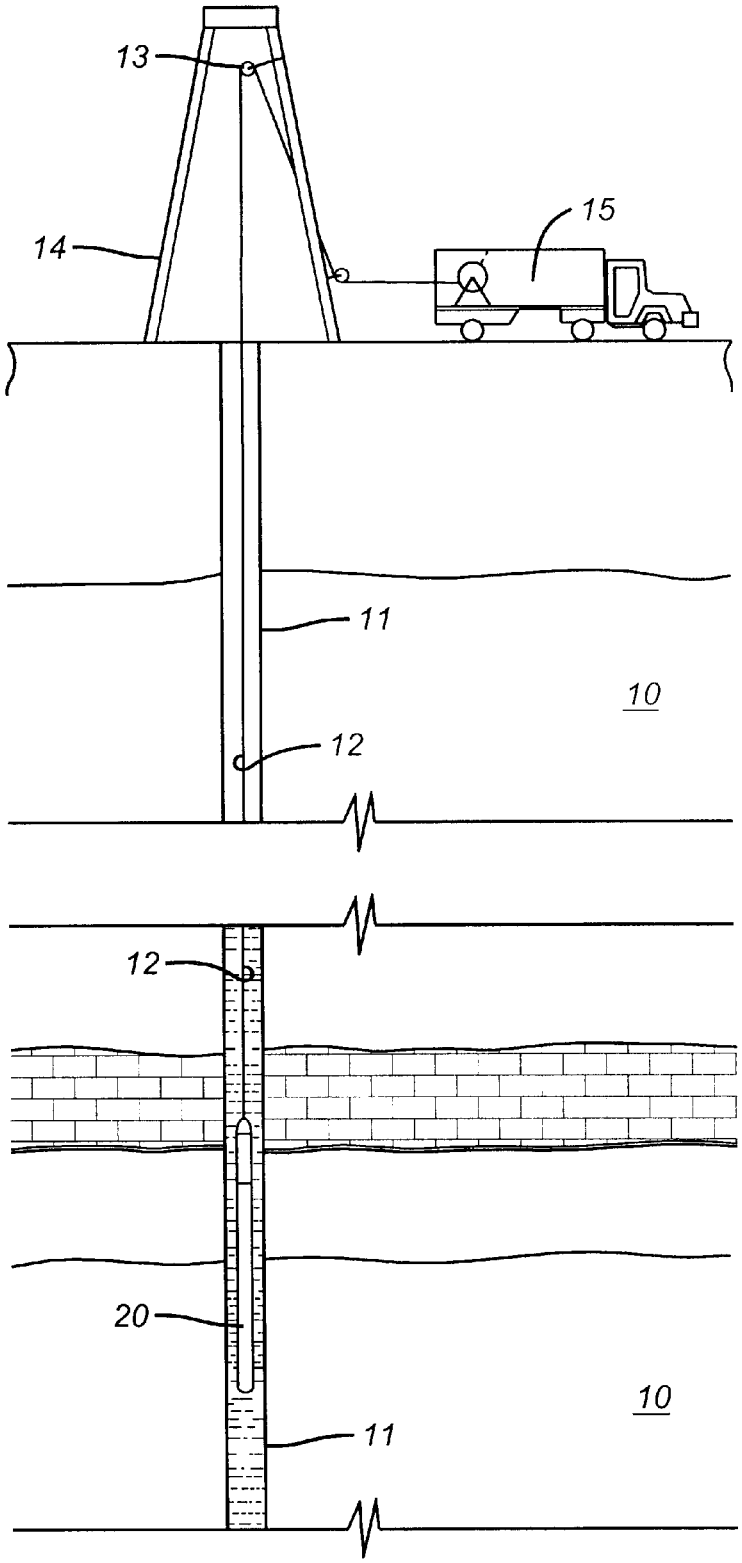
FIG. 1 is a schematic earth section illustrating the invention operating environment.

FIG. 1 schematically represents a cross-section of earth 10 along the length of a wellbore penetration 11. Usually, the wellbore will be at least partially filled with a mixture of liquids including water, water and oil mixtures, drilling fluid, and formation fluids that are indigenous to the earth formations penetrated by the wellbore. Hereinafter, such fluid mixtures are referred to as "wellbore fluids". The term "formation fluid" hereinafter refers to a specific formation fluid exclusive of any substantial mixture or contamination by fluids not naturally present in the specific formation. Although it is a theoretical world objective to obtain samples of formation fluid free of wellbore fluid, the actual world reality is that most formation fluid samples will be contaminated to some degree. Hence, one objective of the present invention is to evaluate that level of contamination.

Suspended within the wellbore 11 at the bottom end of a wireline 12 is a formation fluid sampling tool 20. The wireline 12 is often carried over a pulley 13 supported by a derrick 14. Wireline deployment and retrieval is performed by a powered winch carried by a service truck 15, for example.

Figure 2:
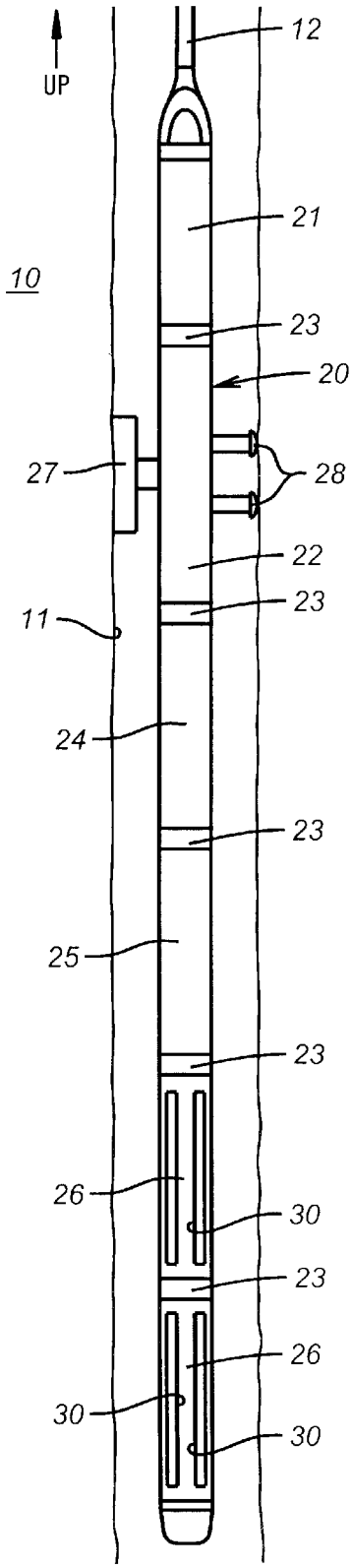
FIG. 2 is a schematic of the invention in operative assembly with cooperatively supporting tools.

Pursuant to the present invention, a preferred embodiment of a sampling tool 20 is schematically illustrated by FIG. 2. Preferably, such sampling tools are a serial assembly of several tool segments that are joined end-to-end by the threaded sleeves of mutual compression unions 23. An assembly of tool segments appropriate for the present invention may include a hydraulic power unit 21 and a formation fluid extractor 22. Below the extractor 22, a large displacement volume motor/pump unit 24 is provided for line purging. Below the large volume pump is a similar motor/pump unit 25 having a smaller displacement volume that is quantitatively monitored as described more expansively with respect to FIG. 3. Ordinarily, one or more tank magazine sections 26 are assembled below the small volume pump. Each magazine section 26 may have one, two, three or more fluid sample tanks 30.

The formation fluid extractor 22 comprises an extensible suction probe 27 that is opposed by borewall pistons 28. Both, the suction probe 27 and the opposing pistons 28 are hydraulically extensible to firmly engage the suction probe with the wellbore walls. Construction and operational details of the fluid extraction tool 22 are more expansively described by U.S. Pat. No. 5,303,775, the specification of which is incorporated herewith by reference.

Operation of the tool may, for example, be powered by electricity delivered from the service truck 15 along the wireline 12 to the hydraulic power supply unit 21. Other tool powering systems may include a drill string tool support having a mud driven downhole generator and using the mud column for data transmission.

Figure 3:
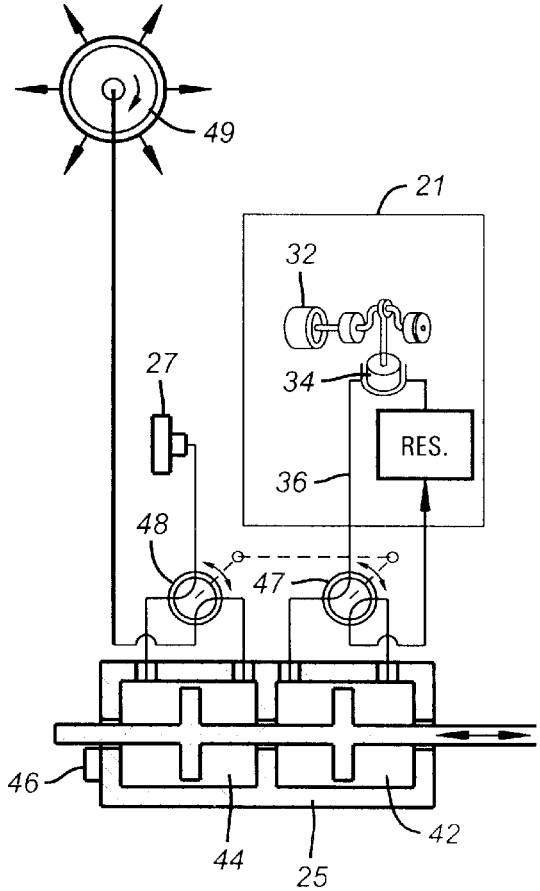
FIG. 3 is a schematic of a representative formation fluid extraction and delivery system.

With respect to FIG. 3, the constituency of the hydraulic power supply unit 21 comprises an A.C. or D.C. motor 32 coupled to drive a positive displacement, hydraulic power pump 34. The hydraulic power pump energizes a closed loop hydraulic circuit 36. The hydraulic circuit is controlled, by solenoid actuated valves 47, for example, to drive the motor section 42 of an integrated, positive displacement, pump/motor unit 25. The pump portion 44 of the pump/motor unit 25 is monitored by means such as a rod position sensor 46, for example, to report the pump displacement volume at any position of the rod. Formation fluid drawn through the suction probe 27, is directed by a solenoid controlled valve 48 to alternate chambers of the pump 44 and to a remotely controlled tank distributor 49. By this route, sample volumes of selected formation fluid are extracted directly from respective in situ formations and delivered to designated sample chambers among the several sample tank tools 30.

As sub-steps in the formation fluid extraction procedure of the present invention, the large volume motor/pump unit 24 is employed to purge the formation fluid flow lines between the suction probe 27 and the small volume pump 25. Otherwise, the motor/pump unit 24 may be substantially the same as motor/pump unit 25 except for the preference that the pump of unit 24 have a greater displacement volume capacity per stroke.

Figure 4:
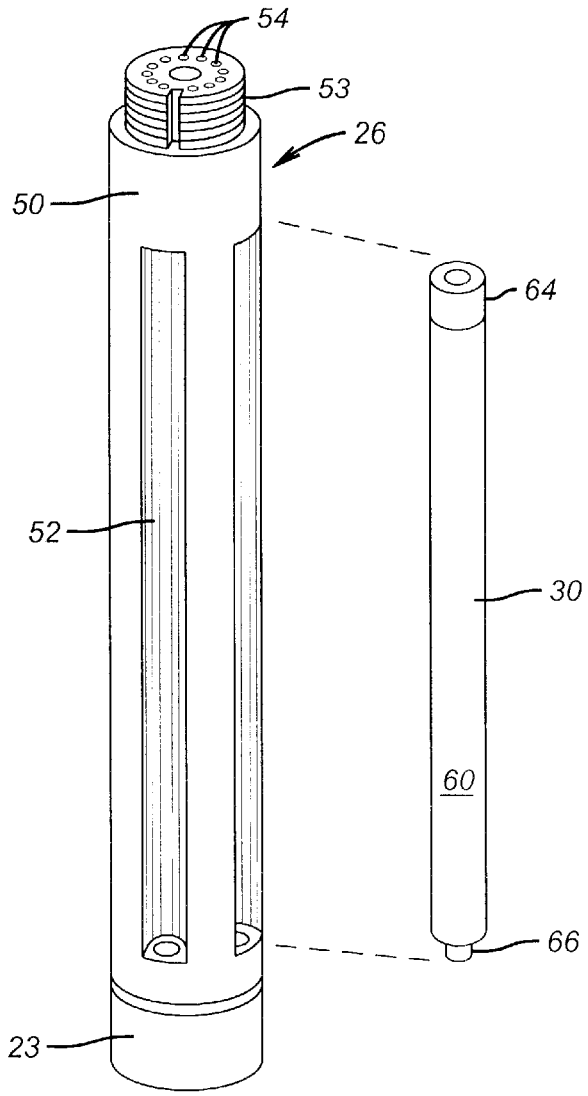
FIG. 4 is an isometric view of a sampling tank magazine.

A representative magazine section 26 is illustrated by FIG. 4 to include a fluted cylinder 50. Preferably, the cylinder 50 is fabricated to accommodate three to six tanks 30. Each tank 30 is operatively loaded into a respective alcove 52 with a bayonet-stab fit. Two or more cylinders 50 are joined by an internally threaded sleeve 23 that is axially secured to the opposite end of a second cylinder. The sleeve 23 is turned upon the external threads of a mating joint boss 53 to draw the boss into a compression sealed juncture therebetween whereby the fluid flow conduits 54 drilled into the end of each boss 53 are continuously sealed across the joint.

Figure 5:
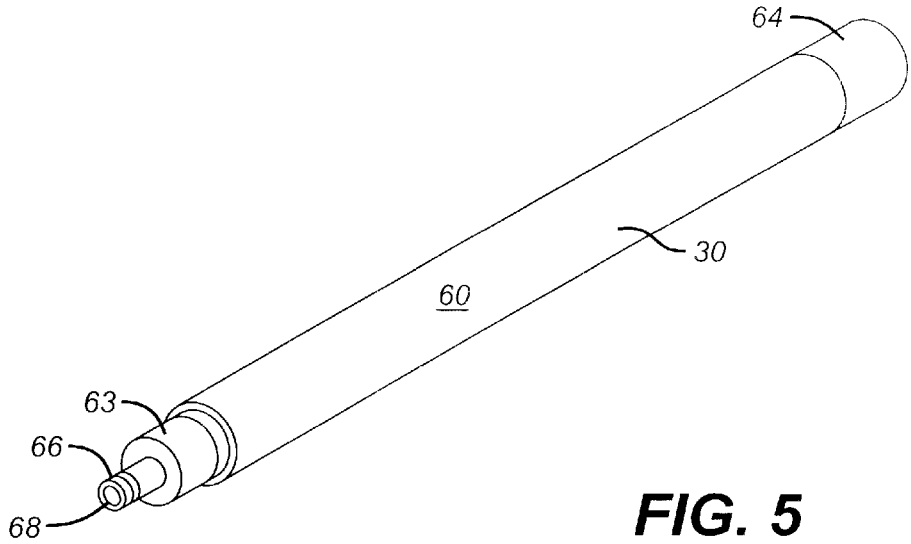
FIG. 5 is an isometric view of an isolated sampling tank.
Figure 6:
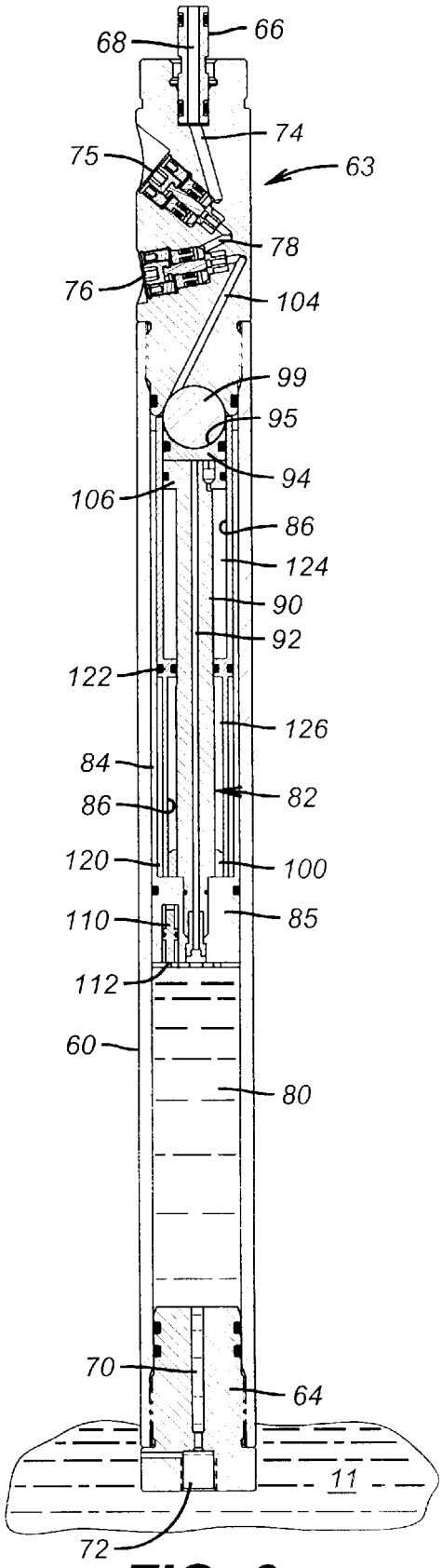
FIG. 6 is an axial section view of a pressure amplification sampling tank.
Figure 7:
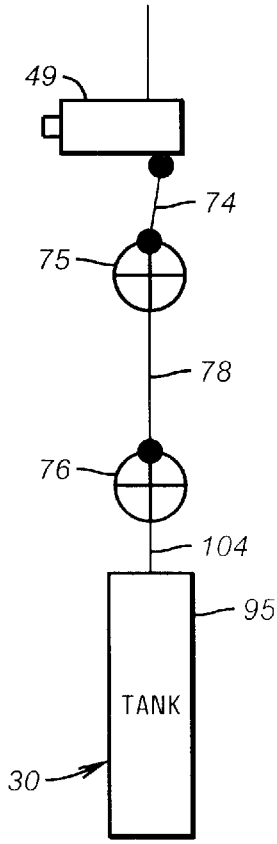
FIG. 7 is a schematic of the present invention.

FIGS. 5 and 6 illustrate each tank 30 as comprising a cylindrical pressure housing 60 that is delineated at opposite ends by cylinder headwalls 63 and 64. The bottom-end headwall 63 comprises a valve sub-assembly having a socket boss and a fluid conduit nipple 66 projecting axially therefrom. A conduit 68 within the nipple 66 is selectively connected by a respective conduit not shown to the tank distributor valve 49 and, ultimately, to the suction probe 27 of the formation fluid extractor 22. With respect to FIG. 9, a remotely controlled purge valve 102 within the body of the magazine 30 selectively connects the nipple conduit 68 with the wellbore fluid environment, or, alternatively, connects the conduit 70 in the top-end headwall 64 to the wellbore fluid environment.

Figure 8:
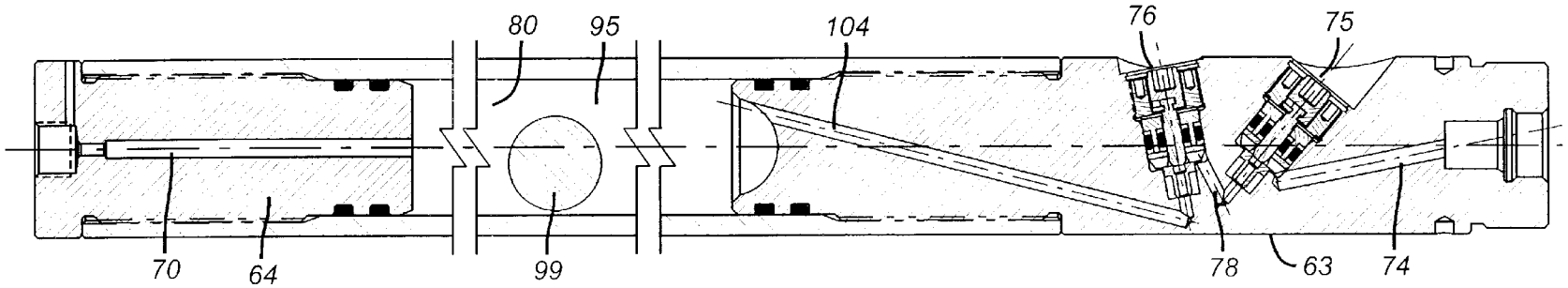
FIG. 8 is a sectioned detail of the invention.
Figure 9:
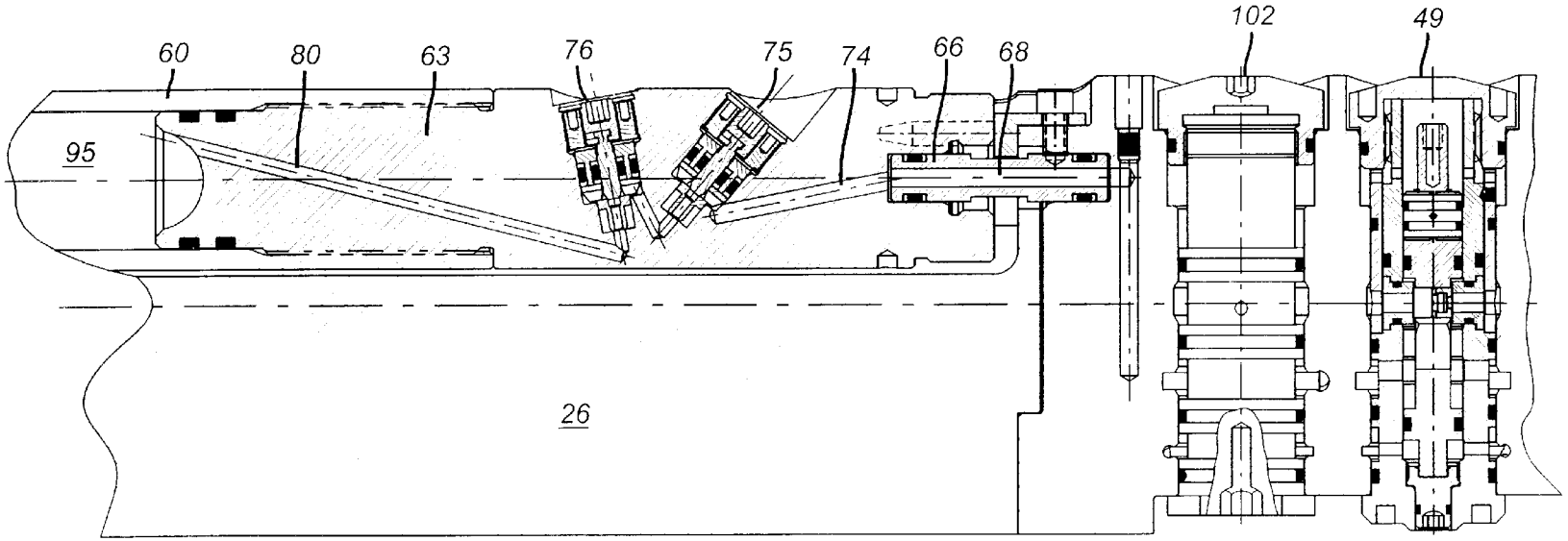
FIG. 9 is a sectioned detail of the invention in partial combination with the magazine control valves.

As shown by FIGS. 8 and 9, within the valve sub-assembly 63 is a supply/discharge flow path extension 74 from the nipple conduit 68 to an outer valve 75. The supply/discharge flow path continues serially from the outer valve 75 with an intermediate conduit 78 to an inner valve 76. From the inner valve 76, the supply/discharge conduit continues with an inner conduit 104 into the primary sample chamber 95. Both valves 75 and 76 are capable of complete flow blockage of the supply/discharge conduit. Accordingly, the conduit 68 connects to the outer valve 75 on the downstream side of the valve seat. Intermediate conduit 78 connects to the outer valve 75 on the upstream side of the valve seat and on the downstream side of the inner valve 76 seat. Inner conduit 104 connects to the inner valve 76 upstream of the valve seat. The valves 75 and 76 are positioned so that the volume 78 between the inner and the outer valve is greater than the volume between the distribution valve 49 and the outer valve 75 in the tank. Additionally, the conduit intermediate volume is preferably about 1% to about 1.5% of the sample chamber volume. The magnitude of the sub-sample volume is a very important element of the sample in situ qualities as well as the size of the sample to make an adequate conclusion. Representatively, the volume of sample chamber 95 may be in the order of 400 to 1000 CC.

Although the operating nature of valves 75 and 76 is preferably manual, it should be understood that many types of remotely actuated valves may also be used for this purpose. In particular, valves 75 and 76 may be electrically powered solenoid valves or fluid driven motor valves.

Referring again to the axial half-section of FIG. 6, the pressure housing top-end headwall comprises a sub 64 having a wellbore fluid inlet conduit 70 that connects the interior bore 80 of the pressure housing 60 with a threaded tubing nipple socket 72. The conduit 70 is a fluid flow path between the interior bore 80 and the in situ wellbore environment that is remotely controlled by the magazine purge valve 102.

Within the interior bore 80 of the pressure housing 60 is a traveling trap sub-assembly 82 that comprises the coaxial assembly of an inner traveling/locking sleeve 86 within an outer traveling sleeve 84 extending from a piston wall 85. Unitized with the outer traveling sleeve 84 by a retaining bolt through the piston wall 85, is a locking piston rod 90. A fluid channel 92 along the length of the rod 90 openly communicates the inner face of a floating piston 94 with the open well bore conduit 70. The floating piston 94 is axially confined within the inner bore of the inner traveling/locking sleeve 86 by a retaining ring. A mixing ball 99 is placed within the sample (formation fluid) receiving chamber 95 that is geometrically defined as that variable volume within the interior bore 80 of pressure housing 60 between the valve sub-assembly and the end area of the traveling trap sub-assembly 82.

A body lock ring 100 having internal and external barb rings selectively connects the rod 90 to the inner traveling/locking sleeve 86. The selective connection of the barbed lock ring 100 permits the sleeve 86 to move coaxially along the rod 90 from the piston 84 but prohibits any reversal of that movement.

Another construction detail of the inner traveling/locking sleeve 86 is the sealed partition 122 between the opposite ends of the sleeve 86. The chamber 124 created between the partition 122 and the piston head 106 of the rod 90 is sealed with the atmospheric pressure present in the chamber at the time of assembly.

The body lock ring 100 between the locking piston rod 90 and the inner bore wall of the inner traveling/locking sleeve 86 above the partition 122 does not provide a fluid pressure barrier. Consequently, the chamber 126 between the partition 122 and the body lock ring 100 functions at the same fluid pressure as the wellbore fluid flood chamber 120 when the flood valve 110 is opened.

Still with respect to FIG. 6, the base of the floating piston wall 84 includes a flood valve 110 having a pintle 112 biased by a spring against a seal seat. The pintle 112 includes a stem that projects beyond the end plane of the piston wall 85. When the end plane of the piston wall 85 is pressed against the inner face of the top sub 64, the pintle 112 is displaced from engagement with the seal seat to admit wellbore fluid into the flood chamber 120. The flood chamber 120 is geometrically defined as the variable volume bounded by the annular space between the outer perimeter of the rod 90 and the inner bore 85 of the outer traveling sleeve 84.

Operational

Sanitation of the sample tank chambers, conduits and other vessels to remove the presence of all contaminating substances coming into contact with a formation sample cannot be overemphasized. Typically, all internal components should be cleaned with a solvent such as toluene to remove hydrocarbon residue. Preparation of the sample tanks 30 prior to downhole deployment includes the opening of the valves 74 and 75. Under the power and control of instrumentation carried by the service truck 15, the sampling tool is located downhole at the desired sample acquisition location. When located, the hydraulic power unit 21 is engaged by remote control from the service truck 15. Hydraulic power from the unit 21 is directed to the formation fluid extractor unit 22 for borewall engagement of the formation fluid suction probe 27 and the borewall piston feet 28. Once engaged, the suction probe 27 provides an isolated, direct fluid flow channel for extracting formation fluid. Such formation fluid flow into the suction probe 27 is first induced by the suction of large volume pump 24, which is driven by the hydraulic power unit 21. Initially, however, a small volume is drawn for a pressure test to confirm that probe 27 is engaged with the borehole wall. With the purge valve 102 set to direct the formation fluid flow from the large volume pump into the wellbore, the large volume pump 24 is operated for a predetermined period of time to flush contaminated wellbore fluids from the sample distribution conduits with a flow of formation fluid drawn through suction probe 27. When the predetermined line flushing interval has concluded, hydraulic power may be switched from the large volume pump 24 to the small volume piston pump 25 and the purge valve 102 is switched to connect the conduit 70 in the top-end headwall with the wellbore. Referring to FIG. 3, formation fluid drawn from the suction probe 27 by the pump 25 is shuttled by a conduit control system such as is represented by 4-way valve 48 into successively opposite chambers 44. Simultaneously, the valve 48 directs discharge from the chambers 44 to a valve manifold 49, which may be a series of valve sets 102 and 49 as shown by FIG. 9, for example, which further directs the formation fluid onto the desired sample tank 30.

Formation fluid enters the tank 30 through the nipple conduit 68 and is routed along the flow paths 74, 78 and 104 into the sample receiving chamber 95. Pressure of the pumped formation fluid in the receiving chamber 95 displaces both, the outer traveling sleeve 84 and the inner traveling/locking sleeve 86, against the standing wellbore pressure in the interior bore 80 of pressure housing 60. When the sample receiving chamber 95 is full, the base plane of the outer traveling sleeve piston wall 85 will engage the inside face of the top sub 64. Thereby, the stem of valve pintle 112 is axially displaced to open the flood valve 110. Internal conduits within the outer traveling sleeve 84 direct wellbore fluid from the seat of valve 110 into the flood chamber 120. The wellbore pressure in the flood chamber 120 bears against the inner traveling/locking sleeve 86 over the cross-sectional area of the flood chamber 120 annulus.

Opposing the flood chamber force on the traveling/locking sleeve 86 are two pressure sources. One source is the formation fluid pressure in the sample chamber 95 bearing on the annular end section of the traveling/locking sleeve 86 as was provided by the small volume pump unit 25. The other pressure opposing the flood chamber pressure is the closed atmosphere chamber 124 acting on the area of the annular partition 122. Initially, the force balance on the traveling/locking sleeve 86 favors the flood chamber side to press the annular end of the sleeve 86 into the sample chamber 95. Since the liquid formation fluid is substantially incompressible, intrusion of the solid structure of the sleeve 86 annulus into the sample chamber volume exponentially increases the pressure in the sample chamber until a final force equilibrium is achieved. Nevertheless, at the pressures of this environment, measurable liquid compression may be achieved.

This axial movement of the inner traveling/locking sleeve 86 relative to the outer sleeve 84 also translates to the piston rod 90, which is secured to the outer sleeve 84 via the retaining bolt through piston wall 85. Consequently, the sleeve 86 partition 122 is displaced toward the piston head 106 to compress the gaseous atmosphere of chamber 124 thereby adding to the equilibrium forces.

Due to the internal and external barb rings respective to the body lock ring 100, movement of the piston 90 relative to the inner traveling sleeve 86 is rectified to maintain this volumetric invasion of the structure 86 into the sample chamber volume.

By compressing the volume of the formation fluid sample, the fluid sample pressure is greatly above the wellbore pressure but lower than the safe working pressure of the chamber. Although this greatly increased in situ pressure declines when the confined formation sample is removed from the wellbore, the operative components may be designed so at surface selected overpressures when and where the collected formation sample is removed from the well, the sample pressure does not decline below the bubble point of dissolved gas. Movement of the inner traveling/locking sleeve 86 further compresses the collected formation fluid sample above the boost capability of the pump 25. Such compression continues until the desired boost ratio is accomplished.

For example, a down hole fluid sample can have a hydrostatic wellbore pressure of 10,000 psi. The typical compressibility for such a fluid is $5\times10^{-6}$ so that a volume decrease of only eight percent would raise the fluid sample pressure by 16,000 psi to 26,000 psi, for a boost ratio of 2.6 to 1.0. When the magazine section 26 and the collected formation fluid sample is raised to the surface of wellbore 11, the formation fluid sample temperature will cool, thereby returning the formation fluid sample pressure toward the original pressure of 10,000 psi. If the downhole fluid temperature is 270° F. and the wellbore 11 surface temperature is 70° F., the resulting 200° F. drop in temperature will lower the fluid sample pressure by approximately 15,300 psi in a fixed volume, thereby resulting in a surface fluid sample pressure of approximately 10,700 psi.

To hold the volume of fluid sample chamber 95 constant as the magazine 26 is removed from the wellbore 11, inner traveling/locking sleeve 86 is fixed relative to outer traveling sleeve 84 during retrieval of the magazine 26. The invention accomplishes the fixed relationship by means of the body lock ring 100. This mechanism permits additional boost to be added to the formation fluid sample pressure within the sample chamber 95 as a proportionality of the in situ wellbore pressure. For example, the magazine section 26 may subsequently be lowered to additional depths within a wellbore 11 where the hydrostatic pressure is greater than a prior sample extraction. The hydrostatic wellbore pressure increase is transmitted through flood valve 112 into flood chamber 120 to further move the inner traveling/locking sleeve 86 and to further compress the formation fluid sample within the sample chamber 95 to a greater pressure. Such pressure boost can be accomplished quickly and magazine 26 removed to the surface of wellbore 11 before a significant amount of heat from the additional wellbore depth is transferred to the previously collected formation fluid sample.

At the surface of wellbore 11, the outer valve 75 of the two valves 75 and 76 is closed to trap the formation fluid sample within the chamber 95. While still connected with the magazine 26, and the inner valve 76 open, the purge valve 102 is switched to vent the nipple conduit 68 outside of the outer valve 75. The tank 30 may thereafter be safely removed from its respective alcove 52 in the magazine 26.

With the tank 30 isolated from the magazine 26, and the inner valve 76 open, the tank 30 is heated and agitated to restore homogeneity to the fluid in conduits 104 and 78 with the fluid in sample chamber 95. Thereafter, the valve 76 is closed and a receiving tank, not shown, may be connected to the nipple 66. By closing the inner valve 76, the enclosed spacial volume is reduced by the intrusion of the valve pintle element. Such spacial volume reduction increases the pressure of the sub-sample in the conduit 78. The receiver tank includes a compensation piston to accommodate the volume change and maintain the in situ sample qualities. The outer valve 75 is then opened to discharge wellbore fluid trapped in the conduit 78 between the valves 75 and 76. This small volume fluid sample captured in the receiving tank, may provide operators with an indication of the contamination level of the fluid actually trapped in the sample chamber 95. Mud filtrate, wellbore water, mud cake, drilling fluid and other contaminants are readily discerned from this fluid sample. If contamination is excessive, it is known immediately, while all sampling equipment is on the well site, that another sample acquisition procedure may be undertaken.

Although the invention has been described in terms of certain preferred embodiments, it will become apparent to those of ordinary skill in the art that modifications and improvements can be made to the inventive concepts herein without departing form the scope of the invention. The embodiments shown herein are merely illustrative of the inventive concepts and should not be interpreted as limiting the scope of the invention.

What is claimed is:

1. An apparatus for isolating a sub-sample of earth formation fluid, said apparatus comprising:

(a) a high pressure fluid receiving chamber;

(b) a conduit for both receiving and discharging the formation fluid into and from said chamber; and, (c) at least two valves in said conduit delineating an intermediate volume within said conduit whereby a sub-sample of formation fluid may be extracted from said intermediate volume without substantially disturbing the constituency of formation fluid in said receiving chamber.

2. An apparatus as described by claim 1 wherein said receiving chamber and conduit are structurally combined within an independent housing member.

3. An apparatus as described by claim 2 wherein said receiving chamber comprises variable volume structure.

4. An apparatus as described by claim 1 wherein said intermediate volume is about 1% of the volume of said receiving chamber or greater.

5. An apparatus for recovering a high pressure sample of earth formation fluid, said apparatus comprising a formation fluid extraction tool, a formation sample receiving tank and a pump for transfer of said sample from said extraction tool into said tank, said receiving tank having a sample receiving chamber and a conduit for both transfer of the formation fluid from said pump into said receiving chamber and for discharging the formation fluid from said chamber, said conduit having a plurality of valves for selectively closing and opening the flow continuity of said conduit.

6. An apparatus as described by claim 5 having a first remotely controlled valve in said conduit.

7. An apparatus as described by claim 6 having a second remotely controlled valve to vent said conduit.

8. An apparatus as described by claim 5 wherein a plurality of said tanks are operatively combined in a magazine, each tank of said plurality being separable from said magazine and at least two of said valves being separable from said magazine with each of said tanks.

9. An apparatus as described by claim 8 having a first remotely controlled valve in said conduit secured within said magazine independent of said tanks.

10. An apparatus as described by claim 9 having a second remotely controlled valve in said conduit secured within said magazine independent of said tanks for selectively venting fluid pressure from said conduit.

11. An apparatus as described by claim 5 comprising at least two valves in said conduit dividing said conduit into at least three segments between said pump and the sample receiving chamber.

12. An apparatus as described by claim 11 wherein an intermediate segment of said conduit between said two valves comprises a volume of about 1% of the volume of said sample receiving chamber or greater.

13. An apparatus as described by claim 11 wherein a first segment of said conduit is connected to a first side of a first valve seat, a second segment of said conduit is connected to a second side of the first valve seat, the second segment of said conduit being connected to a first side of a second valve seat and a third segment of said conduit connected to a second side of the second valve seat.

14. A method for extracting a sub-sample of high pressure well formation fluid comprising the steps of:

(a) within a well bore, charging a variable volume chamber with a highly pressurized quantity of formation fluid through a conduit having a pair of valves positioned therein to delineate an intermediate portion of said conduit between said valves;

(b) raising said variable volume chamber to the surface;

(c) closing a first of said valves;

(d) blending fluid in said intermediate portion with fluid in said chamber;

(e) closing a second of said valves;

(f) aligning said conduit with an analysis receptacle; and, (g) opening said first valve to deposit a sub-sample portion of formation fluid in said intermediate portion of said conduit into said analysis receptacle.

15. A method as described by claim 14 wherein the volume of said sub-sample is about 1.0% of the volume of said variable volume chamber or greater.

16. A method of recovering a high pressure sample of earth formation fluid said method comprising the steps of:

(a) extracting a sample of the formation fluid;

(b) pumping said sample through a supply/discharge conduit into a sample receiving tank, said conduit having first and second valves therein for delineating a miniature sample of the formation fluid therebetween;

(c) raising said tank to the earth's surface;

(d) closing said first valve;

(e) blending the sample in said tank with said miniature sample;

(f) closing said second valve;

(g) opening said first valve to release said miniature sample of formation fluid; and, (h) analyzing said released miniature sample for contaminants.

17. A method as described by claim 16 wherein a remotely controlled valve in said conduit between a pump and said first valve is opened after said second valve is closed.

18. A method as described by claim 16 wherein the volume of said miniature sample is about 1% of the volume of said sample receiving tank or greater.

19. A method of recovering a high pressure sample of earth formation fluid comprising the steps of:

(a) providing a formation fluid sample receiving vessel having a sample charging conduit, the flow continuity of a sample of formation fluid into said receiving vessel along said charging conduit being selectively terminated by at least two serially aligned valves therein;

(b) placing said vessel in a wellbore;

(c) charging said vessel in situ of said wellbore with a quantity of the formation fluid;

(d) removing said vessel from said wellbore;

(e) closing a first of said charging conduit valves most distal from said vessel and opening a second of said charging conduit valves most proximate of said vessel;

(f) agitating said sample within said vessel; and, (g) closing said second valve followed by opening said first valve to release the formation fluid in said conduit between said valves.

20. A method as described by claim 19 wherein the pressure of the formation fluid charged into said vessel is increased above the in situ pressure prior to removing said vessel from said wellbore.

21. A method as described by claim 20 wherein the pressure of the formation fluid in said vessel is increased by a mechanical reduction of the vessel volume.

22. A method as described by claim 19 wherein said sample is also heated within said vessel prior to closing said second valve.

23. A method as described by claim 19 wherein the volume of the formation fluid in said conduit between said valve is about 1% of the volume of said formation fluid or greater.

* * * * *